US006253429B1

(12) United States Patent
Zolin

(10) Patent No.: US 6,253,429 B1
(45) Date of Patent: Jul. 3, 2001

(54) MULTI-VANE METHOD FOR HYDROENHANCING FABRICS

(75) Inventor: Paul F. Zolin, Kennebunk, ME (US)

(73) Assignee: Textile Enhancements International, Inc., Brunswick, ME (US)

( * ) Notice: Subject to any disclaimer, the term of this patent is extended or adjusted under 35 U.S.C. 154(b) by 0 days.

(21) Appl. No.: 09/416,283

(22) Filed: Oct. 12, 1999

(51) Int. Cl.[7] ..... D04H 1/46
(52) U.S. Cl. ..... 28/104; 28/167
(58) Field of Search ..... 28/104, 105, 167, 28/106; 68/200, 205 R

(56) References Cited

U.S. PATENT DOCUMENTS

| | | | | |
|---|---|---|---|---|
| 3,403,862 | * | 10/1968 | Dworjanyn | 28/104 |
| 3,449,809 | | 6/1969 | Shin | 28/72.2 |
| 3,560,326 | | 2/1971 | Bunting | 161/169 |
| 3,873,255 | * | 3/1975 | Kalwaites | 28/104 |
| 4,069,563 | | 1/1978 | Contractor | 28/105 |
| 4,967,456 | | 11/1990 | Sternlieb | 28/104 |
| 5,136,761 | | 8/1992 | Sternlieb | 28/104 |
| 5,301,401 | * | 4/1994 | Suzuki et al. | 28/104 |
| 5,428,876 | * | 7/1995 | Boulanger et al. | 28/104 |
| 5,761,778 | * | 6/1998 | Fleissner | 28/105 |
| 5,791,028 | | 8/1998 | Zolin | 26/1 |
| 5,806,155 | | 9/1998 | Malaney | 28/167 |

FOREIGN PATENT DOCUMENTS

| | | | |
|---|---|---|---|
| 739652 | 8/1966 | (CA) | 28/76 |

* cited by examiner

*Primary Examiner*—Amy B. Vanatta
(74) *Attorney, Agent, or Firm*—Charles F. Seyboldt

(57) ABSTRACT

A method and system for improving the appearance, covering ability and physical properties of woven fabrics by supporting the fabric which is to be treated on a foraminous surface, directing a plurality of columnar liquid streams in the form of oblique vanes against the fabric at an angle which is oblique to the warp direction of the cloth. The columnar streams impinge the cloth under pressure which is sufficient to penetrate and effect an enter-entangling of the fibers in the fabric, and the fabric which is thus treated is advanced under similar streams to treat substantially the entire surface of the fabric. The direction of the jets impinges on opposite sides of the fabric and they are oriented in a position which places them in direct opposition of one another.

17 Claims, 12 Drawing Sheets

FIG.1
PRIOR ART
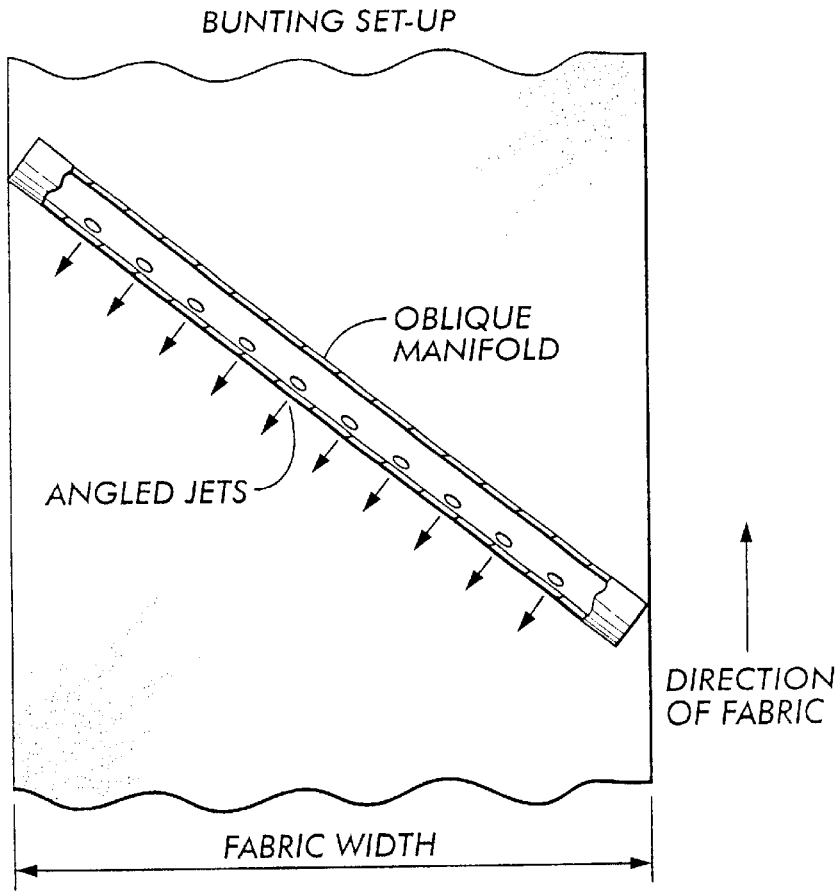
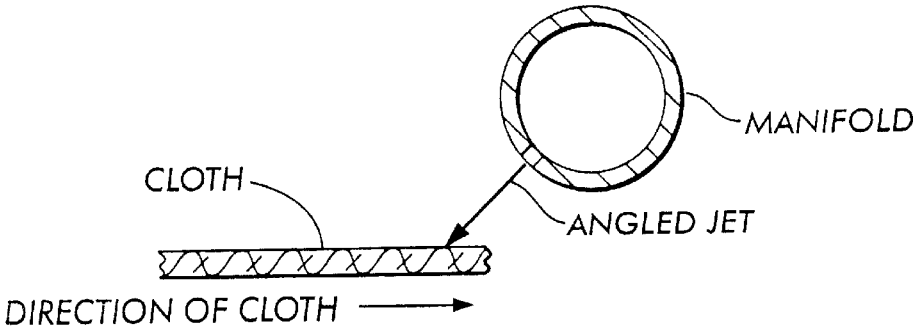
FIG.2
PRIOR ART

FIG.8A
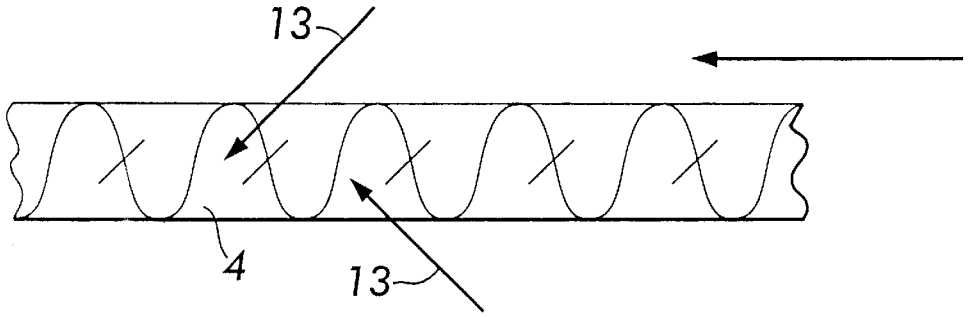
FIG.8B
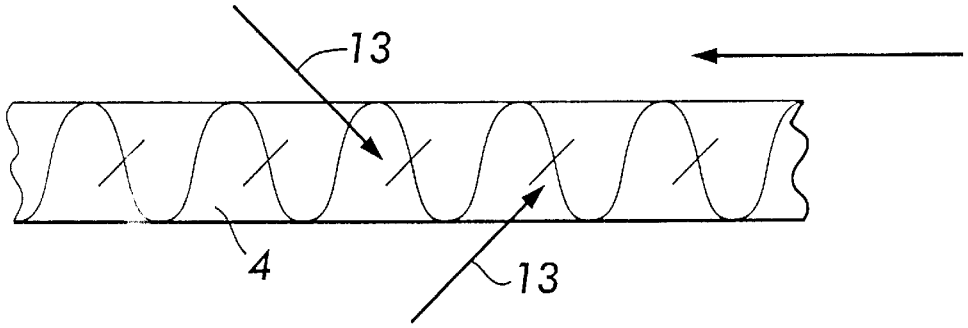
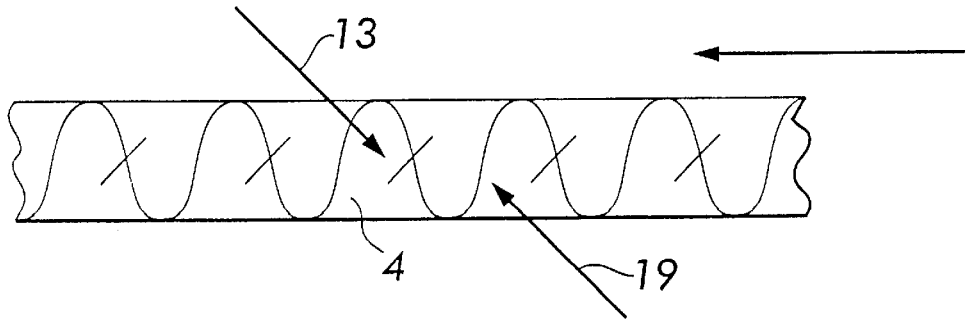
FIG.8C

FIG.9
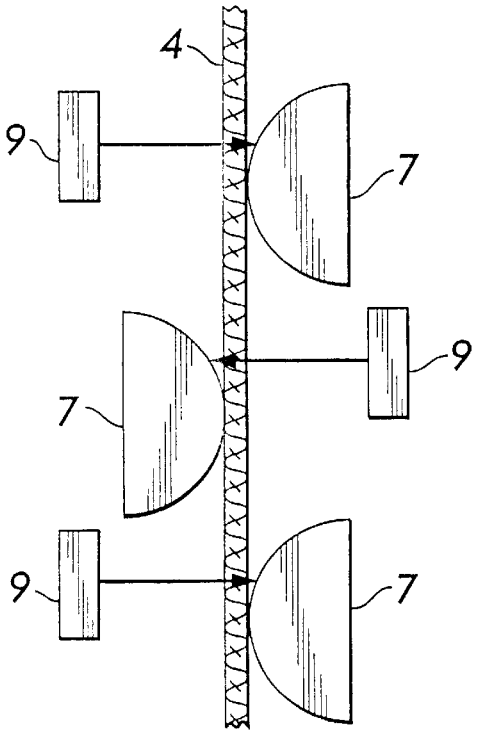
FIG.10
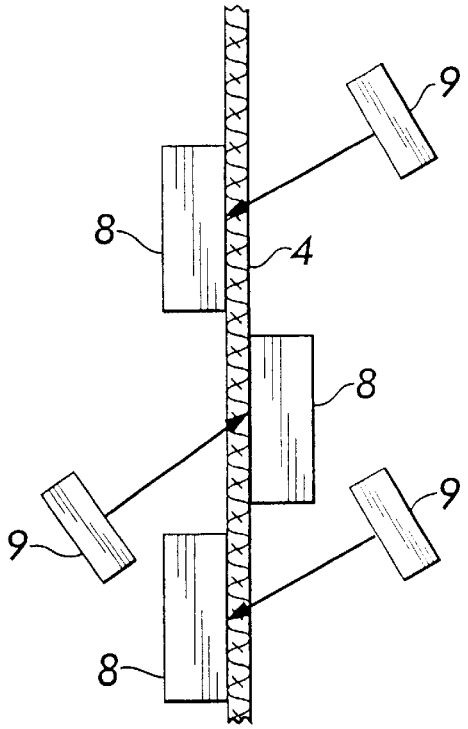
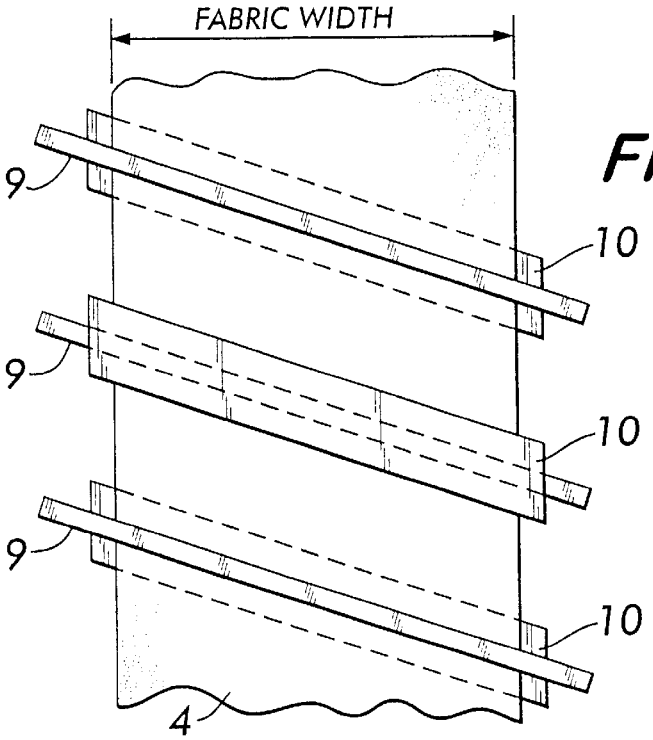
FIG.11

FIG.12
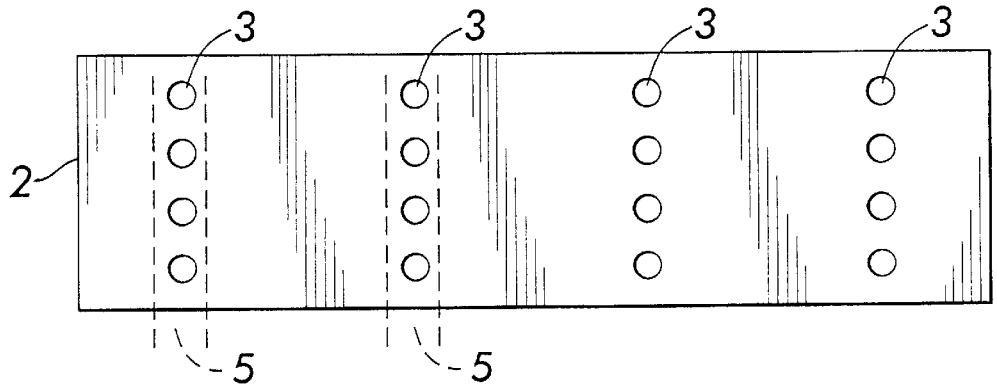
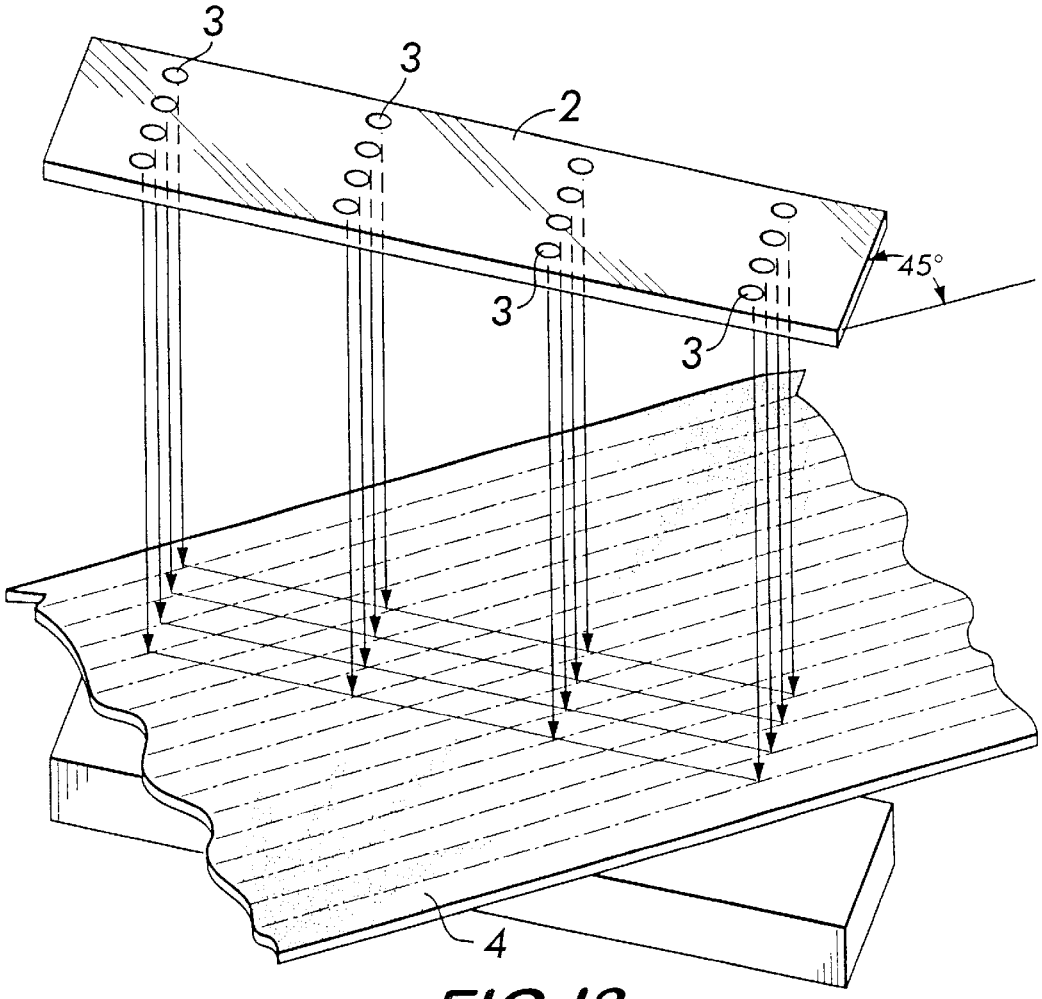
FIG.13

FIG.17A
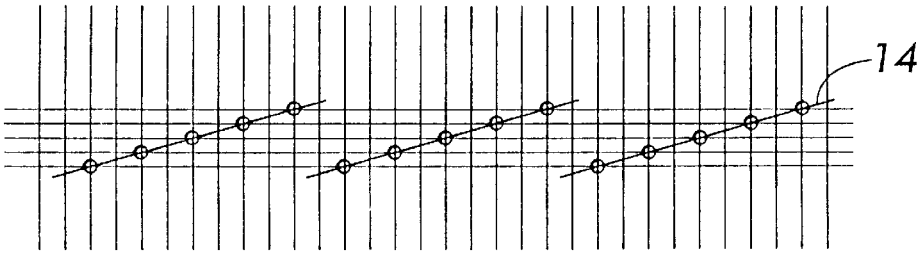
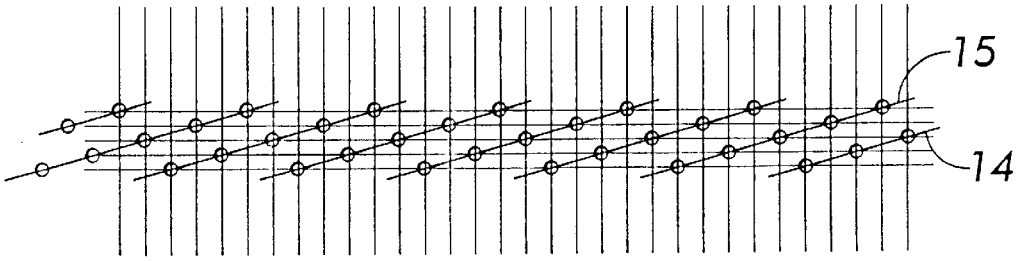
FIG.17B 16
9
17
20
16
17
17

MULTI-VANE METHOD FOR HYDROENHANCING FABRICS

This invention relates to a novel hydroenhancement system and method for improving the quality of textiles by impacting the unfinished fabric with high-speed, columnar streams of fluid.

The fabric is supported on a fluid pervious member, and the columnar streams are impelled through a jet strip equipped with biased vanes of jets arranged in series. These jets direct the liquid stream onto the fabric at a biased angle which, according to a preferred embodiment, is greater than five degrees. The fluid pervious support may take several forms but support screens having a fine mesh of about 1,000 openings per inch are particularly suitable.

A fabric treated in this manner exhibits many enhanced attributes which include, for example, an improvement in surface finish, cover, abrasion resistance, drape, air permeability, wrinkle recovery, and the ability of the fabric to withstand edge fray.

BACKGROUND OF THE INVENTION

The earliest reference in the patent literature to the hydraulic entanglement of fibrous sheet materials appears in patents issued to Bunting. In U.S. Pat. No. 3,560,326, Australian Patent No. 287,821 and Canadian Patent No. 739,652, Bunting describes a method for hydraulically treating sheet material using jet strips that are low gauge and uniformly arranged in a continuum and in a vertical orientation to the warp direction of the cloth.

This process represented, at the time, an improvement in the production of non-woven fabric; however, it employed columnar streams that were arranged solely in a single jet row.

Contractor, in U.S. Pat. No. 4,069,563, improved on U.S. Pat. No. 3,560,326 (Bunting) by substituting a staggered array of several jet rows for the single jet row which is there described. The non-woven fabric obtained by this process exhibited increased tensile strength; however, the degree of improvement was only on the order of about ten percent.

The first know reference to the hydraulic entanglement of woven and knit structures was also made by Bunting in Australian Patent 287,821 and Canadian Patent 739,652; however it has since been found that Bunting's use of columnar streams in low gauge and uniformly arranged jet strips in a vertical orientation to the warp direction results in streaking.

To prevent streaking and produce a more random and homogeneous appearance, Bunting positioned the jet streams at a biased angle in relation to the fabric support surface (FIG. 2 and FIG. 16B). When the support is a flat conveyor, the manifold could also be set at an angle which is oblique to the linear direction of the cloth (FIGS. 1 and 15) to produce minutely different impact angles and increase the ratio of jets to thread ends. While this arrangement can be achieved on a conveyor-like flat surface, it has no application in systems where the conveying surface is a roll. Aligning a roll on a bias with respect to the travel of the fabric causes the fabric to deviate from its machine direction path, and this makes tension control and tracking impossible. Moreover, the positioning of the manifold on a bias with respect to the roll makes the gap between each jet and the fabric surface non-equal. For this reason, although Bunting achieved some improvement in the physical and esthetic properties of fabrics treated on a flat surface, it had no practical application when the fabric being treated is supported on a foraminous and/or vacuum roll and the manifold is at an oblique angle.

It was not until Sternlieb, in U.S. Pat. No. 4,967,456, directed a "continuous curtain" of water onto a fabric surface that a practical method for hydro-enhancing fabric was realized.

In Sternlieb, the curtain of water is achieved by utilizing a jet strip 1 (FIG. 4C) having a single row of sixty jets per inch at a jet diameter of 0.005 inches. The jets are perpendicular to the fabric surface and they are arrayed in a manifold that is oriented at a right angle with respect to the direction of travel of the fabric. A vacuum is employed beneath each jet array to assist in the removal of excess water. To achieve the desired enhancement, at least 0.1 horsepower per pound (HP-Hr/Lb) of energy is expended. The means by which energy consumption is calculated, is described in detail in U.S. Pat. No. 3,449,809.

Unfortunately, neither the Bunting or Sternlieb method offers a practical solution to the hydraulic entanglement problem. Sternlieb employs high-density, single row jet strips 1 (FIG. 4C and FIG. 15) which are perpendicular to the fabric surface and, at right angles, to the machine direction of fabric transport (FIGS. 4A and 4B.) This method, using jet strips with 60 holes per inch, has a tendency to produce jet streaks when the holes per inch of the jet strip are less than the number of warp ends per inch in the fabric being processed. Moreover, the number of holes that can be inscribed into a single row jet strip are limited in the Sternlieb method. This limits the number of warp ends that can be processed.

Also, Bunting and Sternlieb describe their mechanisms as single pass operations, that is, the fabric passes under a plurality of manifolds only once. In these systems, the fabric enters at one end and exits at the opposite end as a finished textile.

Also, Bunting and Sternlieb show hydraulic enhancement occurring over a flat surface with a conveying wire serving as a means for transporting the fabric over a vacuum. In the Bunting method, there is no apparatus that employs any other surface.

Accordingly, there is a need for an improved textile hydroenhancing process and apparatus (i.e., system) for producing a variety of novel woven and knit fabrics which exhibit enhanced surface finish, cover, abrasion resistance, drape, reduced air permeability, wrinkle recovery and resistance to edge fray, in a manner which is inexpensive and efficient.

In this specification, reference is made to various terms and, also, the properties of the fabrics which are to be treated and produced; these terms and properties include, for example, "fibrous sheet material"; "yarn count"; "thread count"; and the like.

By "fibrous sheet material" is meant any natural or synthetically occurring sheet-like fabric which is comprised of staple fibers, continuous filaments, yarns or webs, whether they be woven, knitted, or non-woven. Also included are layered composites.

"Yarn count" refers to yarn size, and it defines the relationship between fiber yarn length and weight.

"Thread count" defines the number of ends, picks, wales or courses per inch of a fabric. The count is indicated by enumerating first the number of warp ends per inch followed by the number of filling picks per inch. Accordingly, a fabric having 75 warp ends and 85 filling picks per inch would have a thread count of 75 by 85.

"Bias" or "biased angle" describes the angle formed by the jet(s) and the fabric surface at impact.

"Oblique" or "oblique angle" refers to the orientation of the jet's vane(s) or manifold(s) with respect to the direction of fabric travel.

"Diagonal" or "diagonal angle" is used herein in a general sense to describe an angle other than a "biased angle" or "oblique angle."

SUMMARY OF THE INVENTION

This invention relates generally to a new and improved method and system for hydroenhancing fabrics by utilizing multi-vane jet strips to direct onto the surface of a fabric a plurality of liquid streams at angles which are non-perpendicular to the fabric surface. One virtue of this system is that it avoids the impact zones associated with systems which direct streams onto a fabric surface, along a fill line, in a single plane. Such systems invariably result in the production of a fabric whose pattern is visible to the eye. By non-perpendicular is meant any angle which is not vertical or straight up and down, that is, an angle which diverges from a given straight line so that it is indirectly positioned. Typical of this would be an obtuse or acute angle, and these are used interchangeably herein to express the non-perpendicular relationship between a liquid stream and a fabric surface.

The jet strips employed in this system are characterized by vanes, each of which is discontinuous from an adjoining vane. Each multi-vane jet strip 6 contains three or more apertures per vane row 5 (FIG. 7). The angle formed by the vane row 5 and the jet strip edge is greater than zero degrees (FIG. 7) and is dependent on the number of ends in the fabric 4, the gauge of the vanes, the number of holes in each vane row 5 and the alignment of the vane row 5 with respect to the fabric travel.

This novel concept in strip design provides a practical means for achieving fabric enhancement, particularly for high warp end fabrics. Moreover, it eliminates the need for a vacuum beneath the foraminous roll in most applications, a feature which makes it possible to achieve economies which are not feasible with known systems. For example, it has been found unexpectedly that the method of this invention can achieve a desired degree of hydroenhancement at levels below 0.1 HP-Hr/Lb, and in some cases, levels as low as 0.05 HP-Hr/Lb. These economies and parameters are realized equally in both reciprocating machines and continuous non-reciprocating machines, illustrations of which appear in FIG. 5 and FIG. 6, respectively.

This invention also provides a new low-friction impact surface for supporting the fabric that is to be treated. This low-friction surface may consist of a polished stainless steel support or a smooth and polished synthetic support, fabricated from plastic or an equivalent material. Also included is a stationary foraminous surface box that does not require the use of a conveying wire for a substantially flat fabric path. Moreover, these support means may be oriented, that is, rotated (FIG. 10) or offset (FIG. 9) to a biased position so as to place the support surface at the desired angle under the manifold, or the support surface may be rotated to an angle which is oblique with respect to the direction of fabric travel (FIG. 11). Another option is to inscribe discontinuous vanes parallel to the direction of travel of the fabric (FIG. 12) and obtain the desired oblique angle by orienting the multi-vane strip and impact box with respect to fabric travel (FIG. 13). These features have application in both reciprocating and continuous systems of the type illustrated in FIG. 5, FIG. 6 and FIG. 11.

This invention will now be described in detail by reference to the accompanying drawings.

BRIEF DESCRIPTION OF THE DRAWINGS

FIG. 1 illustrates the oblique jet strip arrangement described in Canadian Patent No. 739,652 (Bunting).

FIG. 2 illustrates in Canadian Patent No. 739,652 (Bunting) the bias positioning of the manifold relative to the direction of the fabric which is being treated.

FIGS. 8A, 8B and 8C illustrate, in the present invention, variations in jet stream impact relative to the direction of fabric travel.

FIG. 9 is a schematic view of a curved impact box.

FIG. 10 is a schematic view of a flat impact box.

FIG. 11 is a schematic view of oblique impact boxes arranged in series.

FIG. 12 is a discontinuous, multi-vane jet strip.

FIG. 13 illustrates a discontinuous, multi-vane jet strip (FIG. 12) whose orientation is at a 45 degree angle relative to fabric travel.

FIGS. 17A and 17B are a schematic comparison of jet row density, showing vanes having a single jet row (FIG. 17A) and vanes having overlapping jet rows (FIG. 17B).

DETAILED DESCRIPTION OF THE PREFERRED EMBODIMENT

Figure 4A:
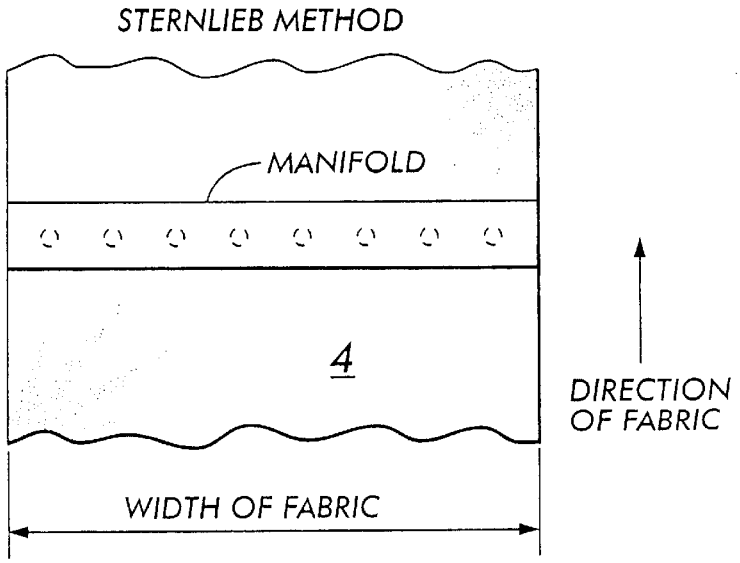
FIG.4A PRIOR ART
FIGS. 4A, 4B and 4C illustrate the manifold, hydroentanglement system and jet strip orientation covered by U.S. Pat. No. 4,967,456 (Sternlieb) and U.S. Pat. No. 5,136,761 (Sternlieb).
Figure 4B:
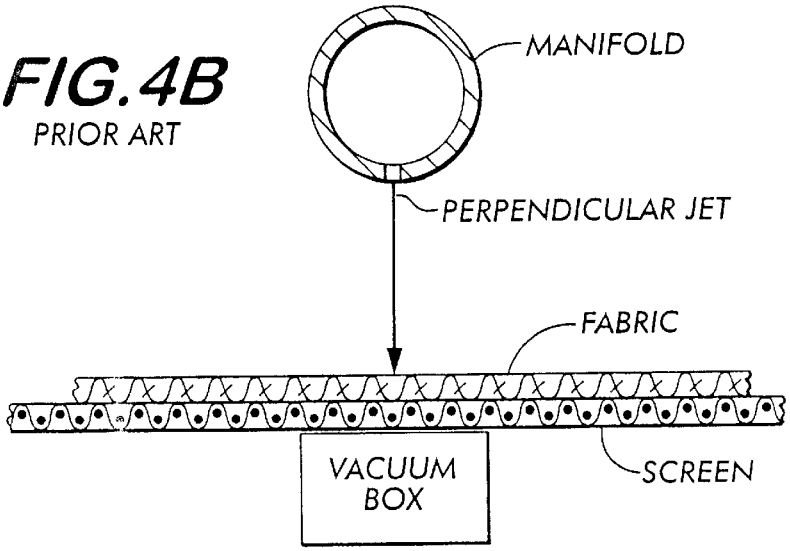
FIG.4B PRIOR ART
Figure 4C:
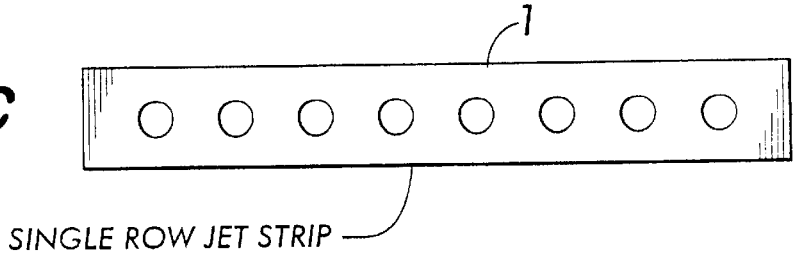
FIG.4C PRIOR ART

This invention provides means for orienting the jet rows of a manifold so as to place them in a position that is biased to the fabric surface. The jets are also amenable to fine tuning so that they can be precisely oriented in the direction of fabric travel. They can be used either with support rolls or a foraminous impact box. When incorporated into a reciprocating mechanism with a cylindrical support surface, this method is superior in efficiency to the "curtain of water" system described by Sternlieb in U.S. Pat. No. 4,967,456 (FIGS. 4A, 4B and 4C). Moreover, this orientation can be used with equal effect in reciprocating assemblies that use an impact box as the fabric-supporting surface.

Figure 7:
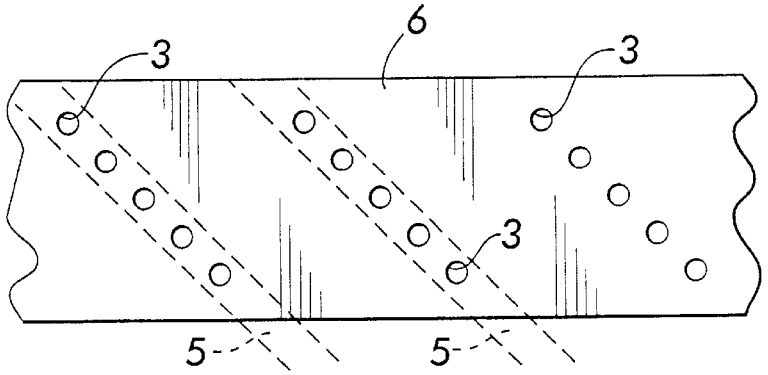
FIG. 7 illustrates a discontinuous oblique jet strip of the present invention.

When an impact box is employed, water is supplied to a jet strip through a manifold body 9 is positioned perpendicular to the fabric 4 which is being treated (FIG. 9). The strips are parallel to the manifold 9 and include jet vanes 5, in multiple rows, which are obliquely oriented with respect to the fabric direction (FIGS. 7, 12 and 13). This oblique orientation, when combined with jets biased to the fabric surface 4, alters each adjacent jet environment and disrupts the otherwise normal tendency of the jets to uniformly enhance fiber entanglement at each jet impact site. Instead, the oblique jet vanes create a random fiber reorientation of the type shown in FIG. 14 and FIG. 18.

It has been found, surprisingly, that the impinging of fabric with a plurality of jet streams at minutely different angles alters the impact environment of the adjacent jets so that the overall effect is to create a random enhancement of the treated fabric without streaking. Moreover, this advantageous effect is achieved with no additional expenditure of energy per textile unit area.

The minutely different impact angles (FIGS. 14 and 18) which are needed to achieve this result, are created by scribing multiple, discontinuous oblique rows of vanes onto a jet strip 6 (FIG. 7) in a manifold 9 that is held parallel to a foraminous roll or a foraminous impact box (FIG. 9 and FIG. 10). When the strip is parallel to the particular impact surface, the adjacent jet vane rows are oblique to the roll or impact box and at an acceptable distance from the impact surface (i.e., the yarn or fibrous material which is being treated). By utilizing a jet strip having a series of angled, discontinuous, short rows 5 (FIG. 7) instead of one or more long continuous rows (FIG. 4C) an acute row angle is achieved while, at the same time, all of the apertures 3 are maintained within an acceptable gap tolerance with respect to the impact surface so that equal energy is imparted per unit area. Further randomizing can be achieved by changing the number of jet holes, and/or jet hole locations, and/or row angles, and/or jet holes in different manifolds while maintaining equal jet distances across the width of the fabric.

It has also been recognized that water which accumulates at jet impact sites absorbs jet energy that would otherwise be transferred to the fabric which is being treated.

Figure 14:
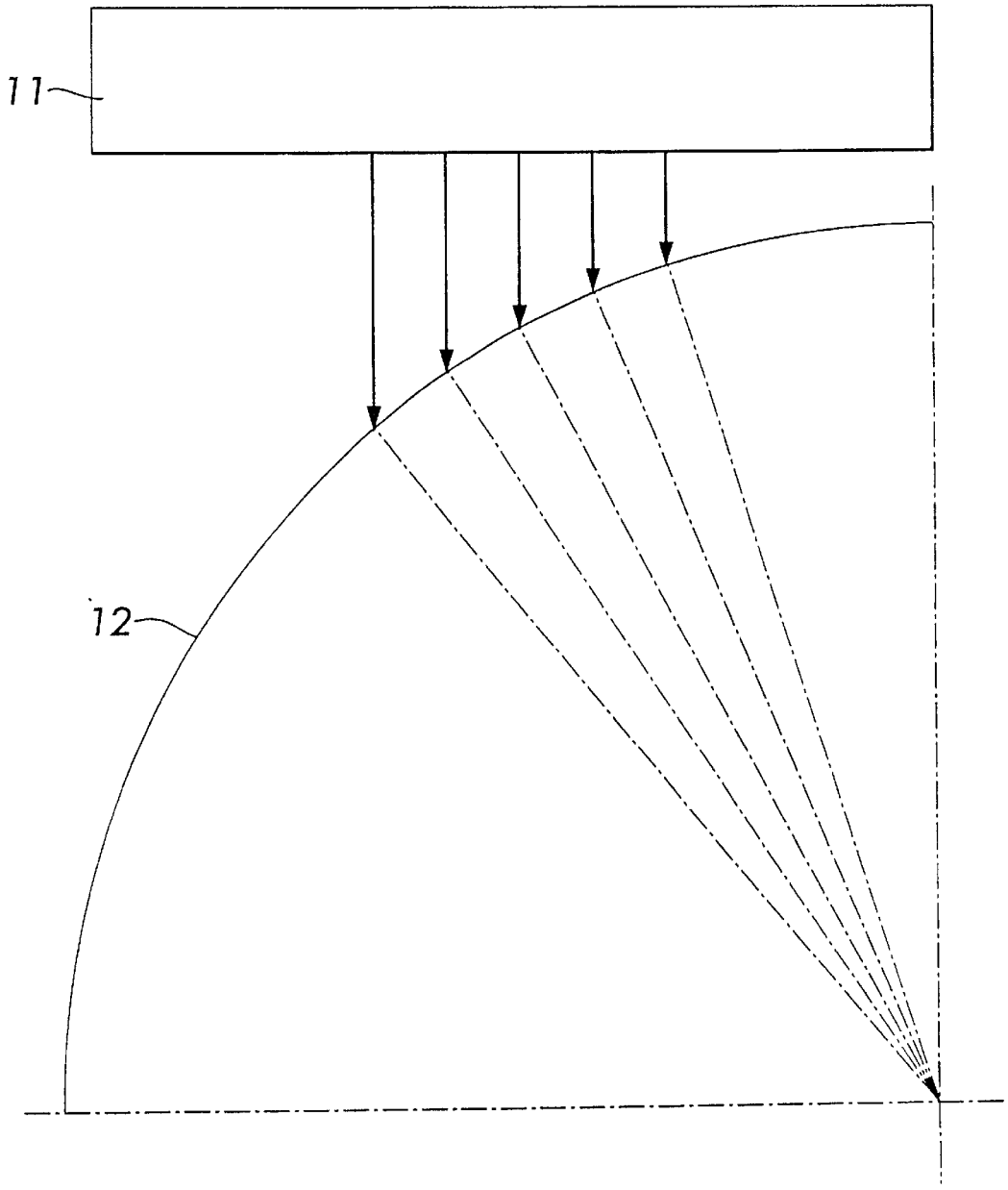
FIG. 14 is a schematic which illustrates differing jet stream offset angles produced by a jet strip equipped with a five-gauge vane on the surface of a drum.
Figure 15:
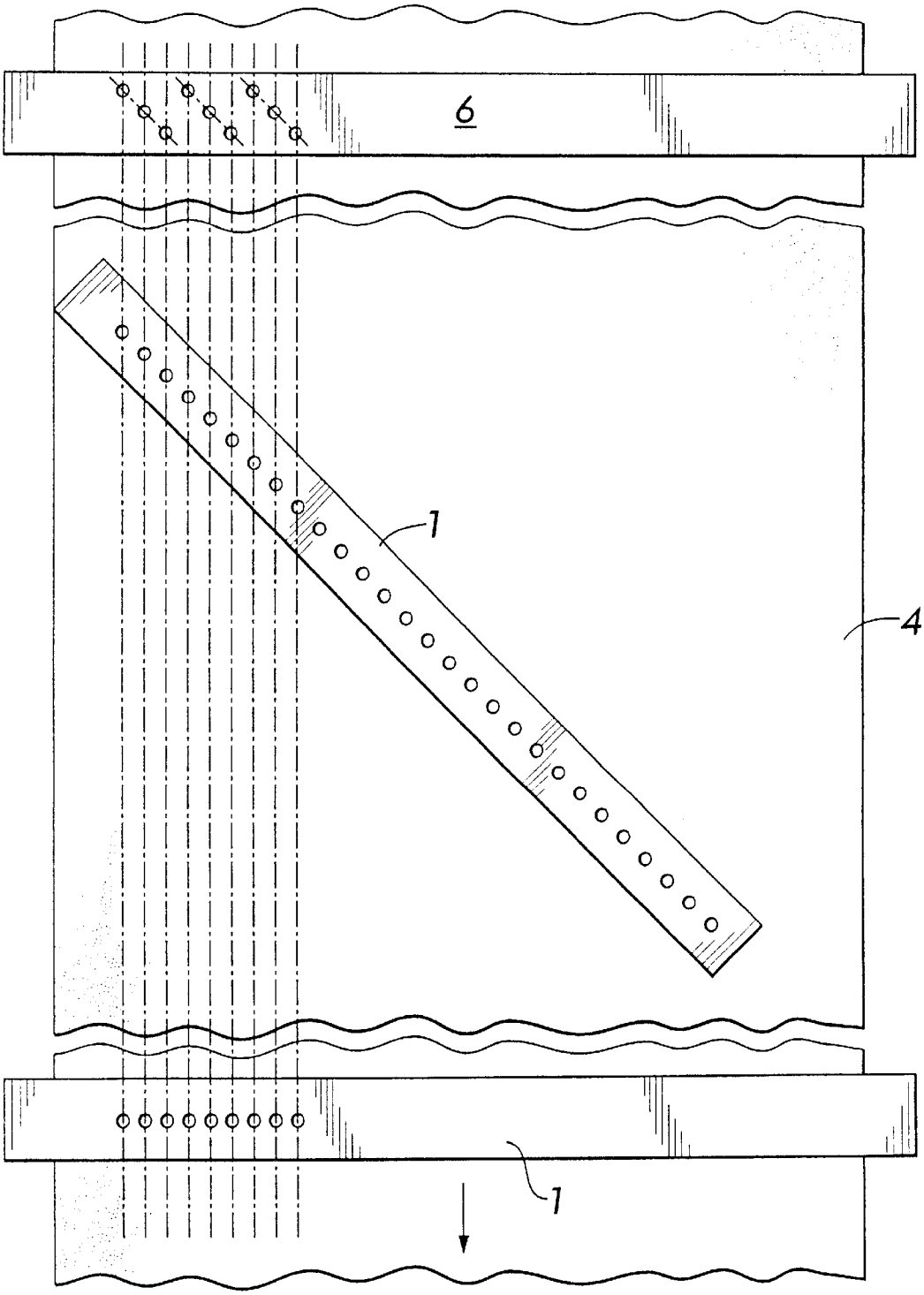
FIG. 15 is a comparison of the jet stream angles produced by several systems relative to fabric travel. All angles are oblique.
Figure 16A:
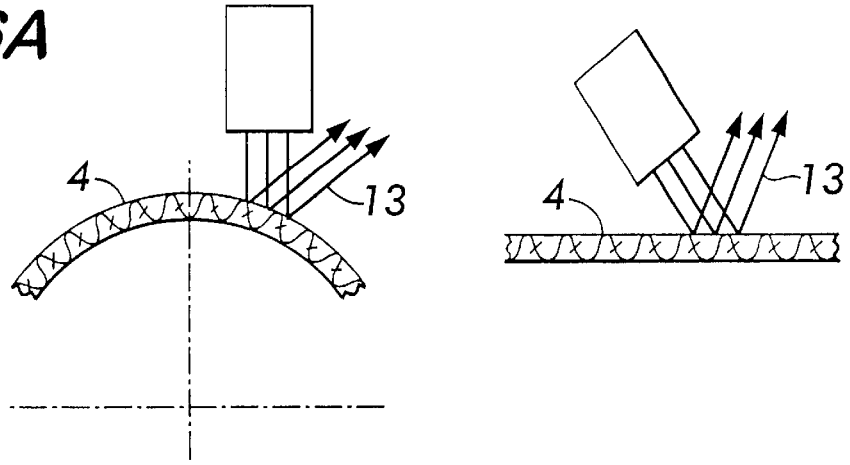
FIG. 16A is a schematic which illustrates, in the present invention, the repercussive effect resulting from the impingement of multiple jet streams onto a fabric surface.
Figure 16B:
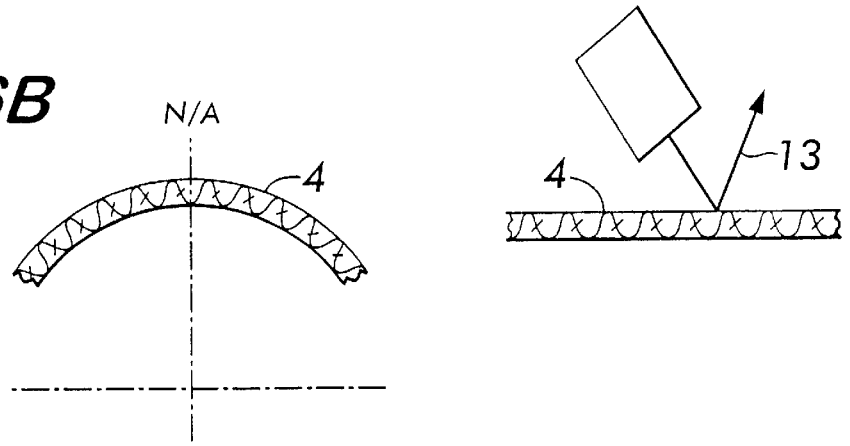
FIGS. 16B and 16C are schematics which illustrate the repercussive effect of impinging one or more jet streams onto fabrics in known systems.
Figure 16C:
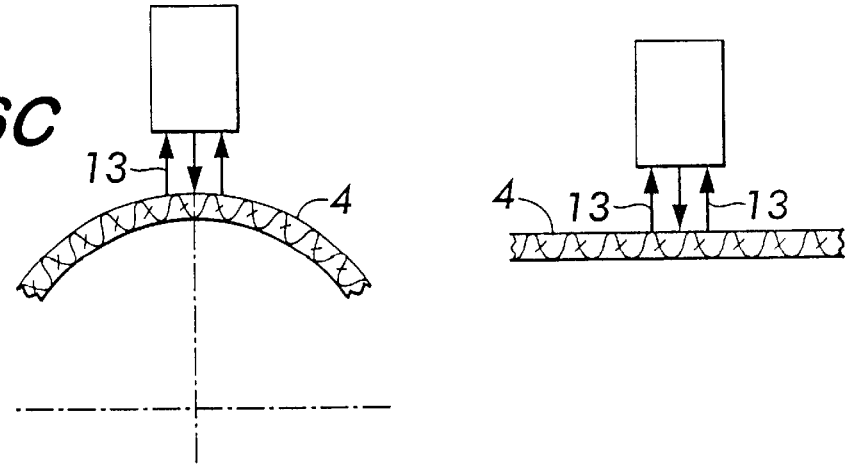

The present invention overcomes this difficulty by placing the jet strips in an offset position 11, that is, a position non-radial to the drum 12 or impact box center (FIG. 14). In this mode, water tends to be deflected from the surface of fabrics 4 which are as dense as textiles and away from the manifold, and this minimizes any accumulation of standing water under the jet impact area (FIG. 3B). By "jet impact area" is meant that area which is bordered by the manifold 9 above and the supporting foraminous surface 18 below (FIGS. 3A and 3B).

Figure 3A:
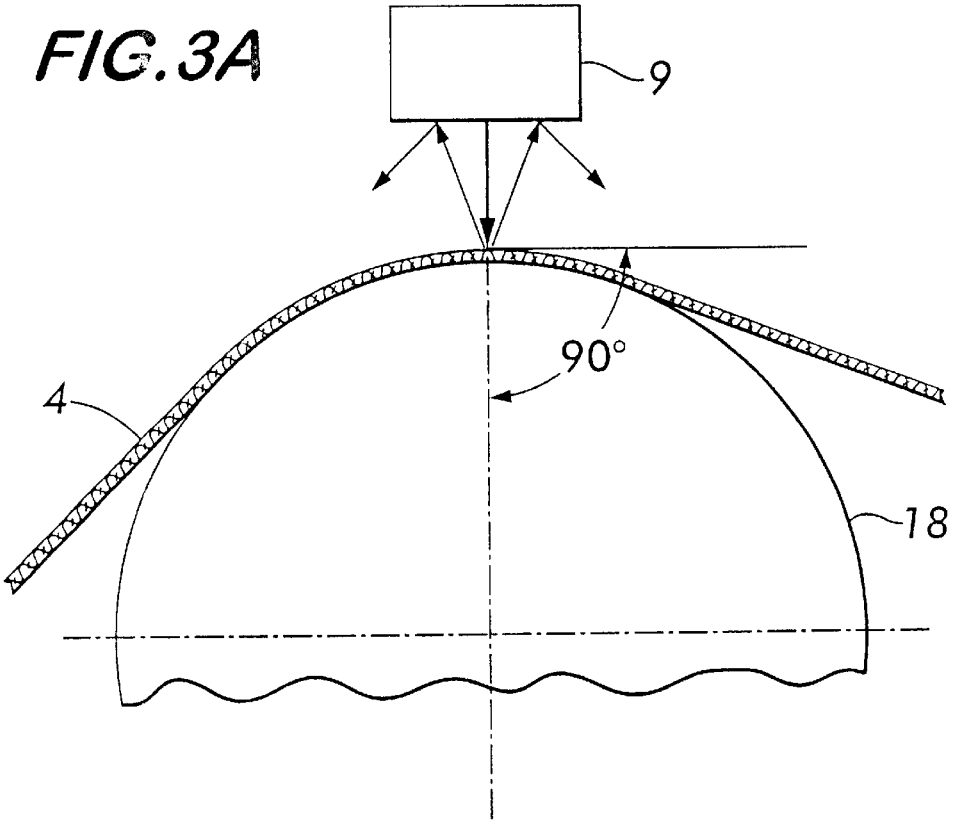
FIG. 3A illustrates the prior art where a manifold and its jet stream are oriented perpendicular to a fabric surface.
Figure 3B:
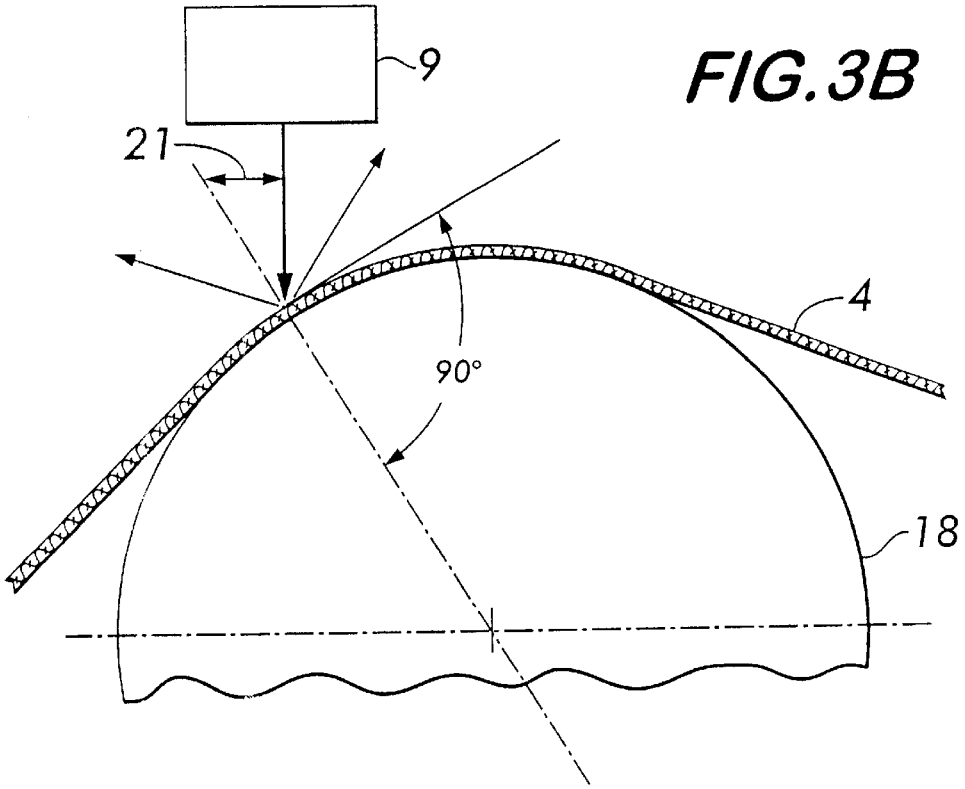
FIG. 3B illustrates, in the present invention, the effect of jet stream impact when the manifold is oriented at an offset to the fabric surface.

By contrast, when the jet row or impact box 9 is perpendicular or radial to the impact surface 18, the water is deflected but it remains principally within the jet impact area and thus produces a greater accumulation of standing water (FIG. 3A).

With materials as dense as woven textiles, a vacuum generally does very little to remove standing water at commercial processing speeds. Foraminous surfaces, however, provide an escape for water by drawing it beneath the fabric so that hydroplaning can be avoided. The net result is a greater rebound force, that is, an enhanced deflection of surface water, and this results in a higher energy transfer to the fabric and an increase in overall efficiency.

Further economies in energy and productivity are also realized when, in the case of fabrics 4 which are to be entangled on opposite sides, the non-radial offset is oriented in the direction of the fabric travel and the jet streams 13 on one side are in direct opposition to the jet streams 19 on the other (FIG. 8C).

Support surface: The impact surface may be a foraminous roll equipped with or without a vacuum, or it may be a curved impact box 7 or a flat impact box 8 with or without a vacuum as shown in FIGS. 9 and 10. The surface of the roll or impact box may be either wire mesh or a finely perforated fine porous surface.

If oblique foraminous impact boxes are employed, and the manifolds are in a parallel position (i.e., they are oblique to the direction of fabric travel) then the jet strip with its discontinuous oblique rows of vanes must be designed with exact spacing between vanes to provide uniform impact density to the fabric which is being treated. In this arrangement, the obliquely oriented impact boxes 10 and the manifolds 9 are in parallel and they are angled in the direction of fabric travel as shown in FIG. 11 and FIG. 13.

FIG. 13 illustrates the orientation of a distinctive perpendicular multi-vane jet strip 2 at an angle which is 90 degrees to the strip edge and 45 degrees with respect to the fabric travel in the manifold and the fill direction of the fabric 4. The combination of angled vanes and oblique impact boxes contribute to increased jet density per unit width of fabric and a concomitant increase in the number of warp ends that can be aesthetically processed.

Figure 5:
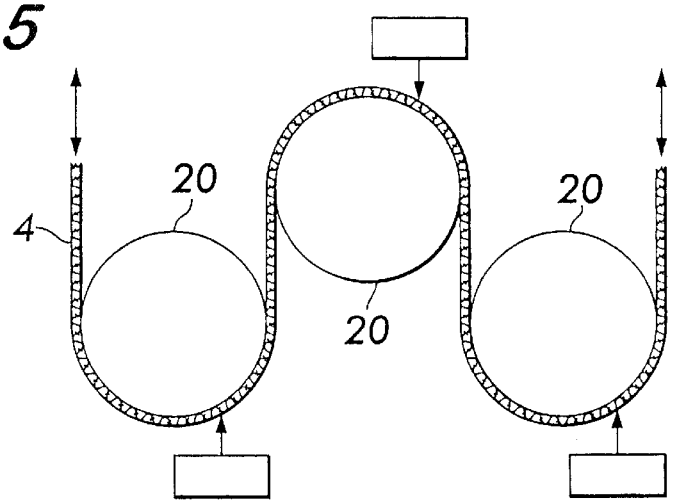
FIG. 5 illustrates, in the present invention, a reciprocating system for hydroenhancing fabrics on a cylindrical surface.
Figure 6:
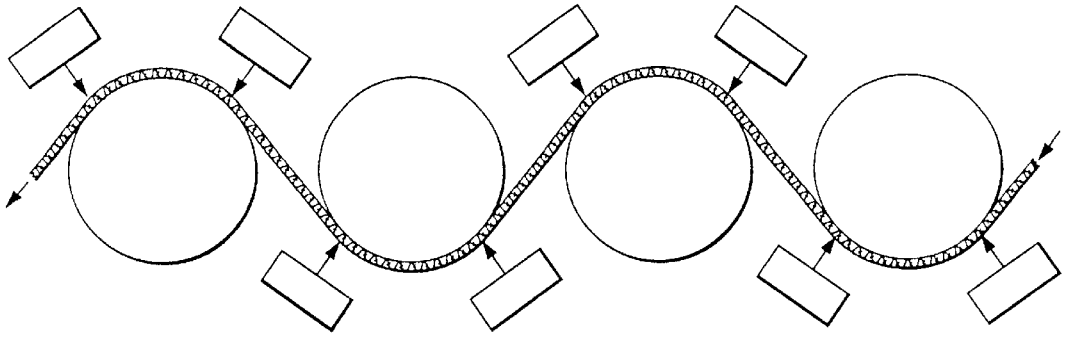
FIG.6 PRIOR ART
FIG. 6 is prior art and illustrates a continuous hydroenhancement system.

Shown in FIG. 5, is a reciprocating mechanism for the hydroenhancement of fabric 4 on a cylindrical surface 20 (FIG. 5). Bunting attempted to achieve a similar result on a flat conveyor wire, however, fine flat wires are difficult to maintain because friction can cause the wire edge to curl and the wire to crease and this creates tracking problems. Moreover, the flat wire orientation contributes to the accumulation of standing water which pools on the fabric surface.

By contrast, it has been found, in the present invention, that a roll or a micro-polished foraminous box, either flat or curved, can be employed without any of the disadvantages associated with flat conveyor wires.

Figure 18:
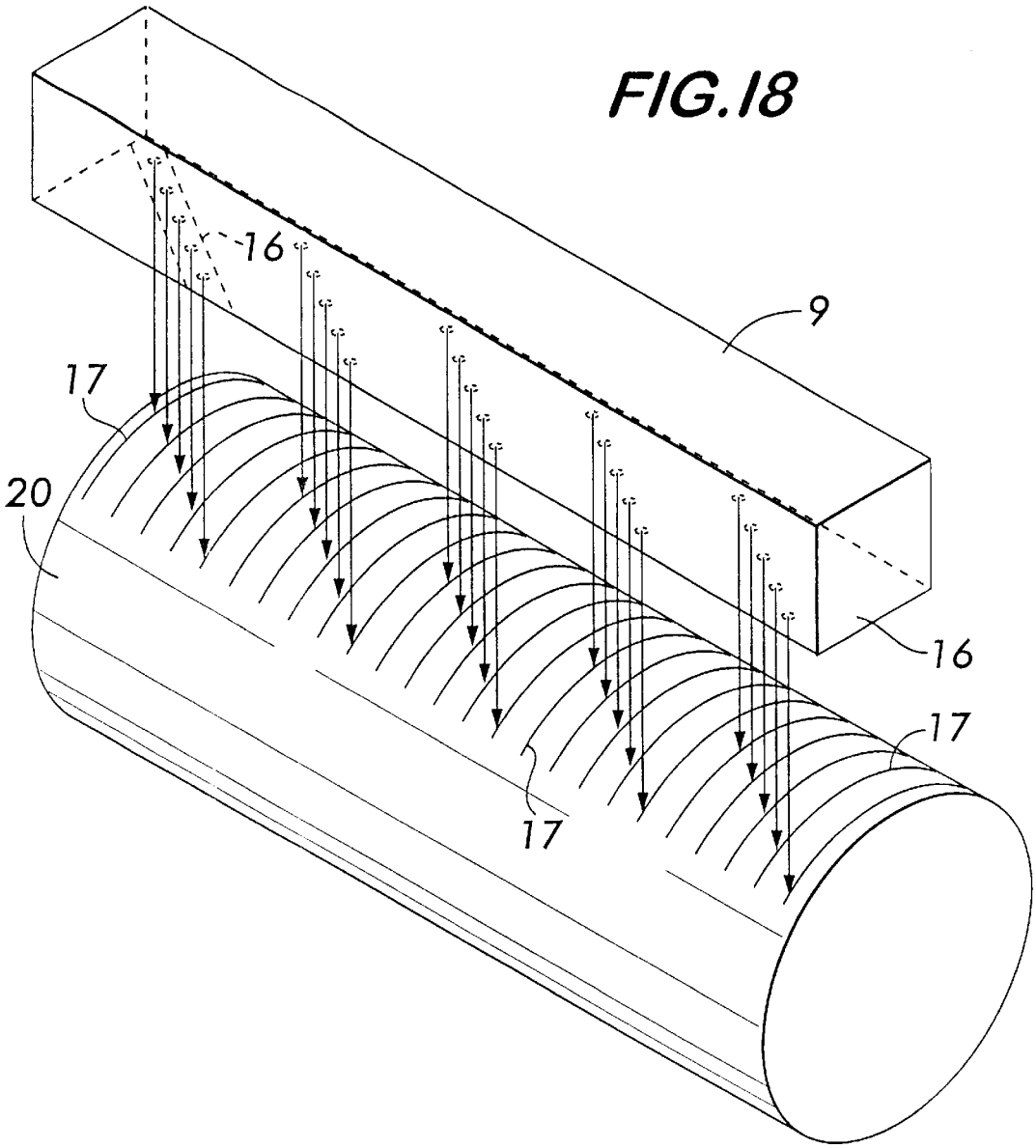
FIG. 18 is an isometric view of the present invention showing the jet stream pattern produced by a jet strip equipped with biased discontinuous vanes.

Jet vane strip: When a roll is employed as the impact surface, the vanes of the jet strip are oriented in such manner as to ensure the oblique jet impact of the columnar streams on the fabric which is being treated (FIG. 18). Multiple jet vanes 16 (FIG. 18) are scribed in an oblique pattern onto the jet strip 6 so that each row is oblique to the manifold 9 (FIG. 7). The jet array thus obtained is then offset from the roll's radial axis by 5 degrees or more 21 (FIG. 3B) so as to further improve impact reception by the fabric on a cylindrical support. An illustration of the jet stream pattern formed by this type of array is shown in FIG. 18. Jet streams emanating from the jet vanes 16 impact the fabric at points equi-distant from each other longitudinally 17 but diagonally to the filling yarns due to the bias angle offset of the manifold to the roll 20 and the oblique angle of the multi-vane strip 6 (FIG. 18). Offset angles in excess of 20 degrees inhibit enhancement by geometrically placing the manifold in a position which is either in too close proximity to the fabric surface or in a position which is too far removed. If the manifold is in too close, deflected water will be entrapped, whereas, if the manifold is positioned too far away from the fabric surface, a concomitant decrease in energy transfer will result.

A preferred embodiment of this invention provides for utilizing a multiple row, low density oblique vaned jet strip 6 (FIG. 7) in the form of a series of vanes of jets impinging the fabric which is to be treated on a biased angle of at least 5 degrees (FIG. 3B). In this embodiment, the support screen is a fine mesh which is pervious to liquids and amenable to the use of vacuum or non-vacuum conditions, however non-vacuum conditions are preferred.

The diameter of the apertures 3 in the jet strip are in the preferred range of from about 0.001 to 0.01 inches; however, other diameter orifices and other orifice shapes can also be employed.

Shown in FIG. 17A is a non-overlapping series of primary discontinuous vanes 14 suitable for processing fabrics; however, when high jet density is needed to process fine, high count fabrics, an over-lapping pattern can double the density (FIG. 17B). This increase in jet density is achieved by inserting secondary discontinuous vanes 15 whose orifices fall between the orifices of the primary vanes 14. The result is an increase in jet density which provides better cover for high count fabrics.

While the preferred embodiments have been fully described and depicted for the purposes of explaining the principles of the present invention, it will be appreciated by those skilled in the art that modifications and changes may be made thereto without departing from the spirit and scope of the invention set forth in the appended claims.

EXAMPLE 1

Fabric Treatment; Opposite Sides

A cotton fabric weighing 8.74 ounces per square yard and containing 24 warp ends of 3.6s cotton count yarn and 20 filling picks of 3.6s cotton count yarn was subjected to six manifolds having 34 oblique vanes per inch. Each vane contains three holes whose jet diameters measured 0.003 "nominal" and provided a water pressure of 1500 psi at a processing speed of 100 feet per minute and an offset angle of five degrees. Alternate sides of the fabric were treated after each manifold. The fabric exhibited a marked improvement in fabric cover when compared against untreated fabric. Testing for air permeability as a measure of enhancement, the untreated fabric exhibited a CFM of 1231 and the treated fabric 709 CFM. This improvement was achieved with a HP-Hr/Lb of 0.089.

EXAMPLE 2

Fabric Treatment; Opposite Sides with Opposing Streams

Three polyester fabrics (4 ounce) labeled Samples A, B and C, were subjected to processing parameters similar to those described in EXAMPLE 1 except that eight manifolds at 1800 psi were employed. Each sample was subjected to the following conditions:

Sample A: This sample was impinged on alternate sides with the impingement always in the same direction as shown in FIG. 8A.

Sample B: This sample was impinged on alternate sides with the impingement always in the opposite direction and opposed to the machine direction of the fabric. This set of conditions is identical to parameters provided by Bunting in Canadian Patent No. 739,562 (See FIG. 8B).

Sample C: This sample was impinged on alternate sides with the impingement always in directly opposing directions as shown in FIG. 8C.

When tested for air permeability, Samples A, B and C exhibited an enhanced capability for reducing fluid flow as evidenced by the following values: Sample A: 680 CFM; Sample B: 686 CFM and Sample C: 592 CFM; an improvement of approximately 13% for Sample C when compared against Samples A and B.

This invention has been described by reference to precise embodiments, but it will be appreciated by those skilled in the art that this invention is subject to various modifications and to the extent that those modifications would be obvious to one of ordinary skill they are considered as being within the scope of the appended claims.

What is claimed is:

1. A method for hydraulically treating a web of fabric so as to impart to one side of the fabric a desired degree of hydroenhancement which comprises:

(a) providing a curved fabric support member having at least one axis of curvature;

(b) supporting the fabric on the fabric support member;

(c) impinging an array of jet streams onto a surface of the fabric, where the jet streams emanate from a manifold having an array of jet orifices, the individual jet streams travel in substantially parallel paths, the paths of the individual jet streams are not directed toward a center of curvature of the fabric support member, and the jet streams impinge the surface of the fabric at a non-normal angle; and (d) moving the web of fabric in a direction that is perpendicular to the axis of curvature of the fabric support member.

2. The method of claim 1 in which the jet streams impinge the surface of the fabric at an angle that is at least 5 degrees from normal.

3. The method of claim 2 in which the fabric is moved in the same direction as the non-normal component of the jet streams.

4. The method of claim 2 in which the fabric is moved in a direction opposite the non-normal component of the jet streams.

5. The method of claim 1 wherein the curved fabric support member is a tubular foraminous surface.

6. The method of claim 5 wherein the foraminous surface is a wire screen or a perforated sleeve.

7. The method of claim 2 which further comprises providing a vacuum means in the curved fabric support member.

8. The method of claim 2 where the manifold has a longitudinal axis, the array of jet orifices is comprised of a series of vanes, each vane comprises three or more jet orifices arranged in a vane line, the vane lines being parallel to one another and angled at least 20 degrees from the longitudinal axis of the manifold, and the vane lines being spaced so that no two jet orifices can lie on a line that is perpendicular to the longitudinal axis of the manifold.

9. The method of claim 8 wherein the diameter of the jet orifices is in the range from about 0.001 to 0.010 inches.

10. The method of claim 8 where the vane lines are spaced so that two jet orifices can lie on a line that is perpendicular to the longitudinal axis of the manifold.

11. The method of claim 2 wherein the fabric web is moved by the array of jet streams in a forward direction and in a reverse direction.

12. The method of claim 5, in which the curved support member is rotating.

13. A method for hydraulically treating a web of fabric so as to impart to both sides of the fabric a desired degree of hydroenhancement which comprises:

(a) providing a curved fabric support member having at least one axis of curvature;

(b) supporting the fabric on the fabric support member;

(c) impinging an array of jet streams onto the first surface of the fabric, where the array of jet streams emanates from a manifold having an array of jet orifices, the individual jet streams travel in substantially parallel paths, the paths of the jet streams are not directed toward a center of curvature of the fabric support member, and the jet streams impinge the first surface of the fabric at a non-normal angle;

(d) impinging an array of jet streams onto the second surface of the fabric, as in step (c); and (e) moving the web of fabric in a direction that is perpendicular to the axis of curvature of the fabric support member.

14. The method of claim 13 wherein the direction of jet stream impingement on the second side of the fabric is directly opposite to the direction of jet stream impingement on the first side of the fabric.

15. The method of claim 14 wherein the axis of curvature of the fabric support member is not perpendicular to the direction of fabric motion.

16. An improvement to the method for hydraulically treating a moving web of fabric using a curved fabric support member; the improvement comprising:

(a) providing a pattern of parallel jet streams emanating from an array of jet orifices in a manifold, where the array of jet orifices is such that a single line cannot be drawn though their centers; and (b) directing the jet streams so that the angle of jet stream impingement is off-perpendicular to the surface of the fabric.

17. The improvement of claim 16, in which the angle of jet stream impingement is at least 5 degrees off-perpendicular to the surface of the fabric.

* * * * *